US007283058B2

(12) United States Patent
Kisner et al.

(10) Patent No.: US 7,283,058 B2
(45) Date of Patent: Oct. 16, 2007

(54) TREE SMOKE DETECTION SYSTEM AND METHOD OF USING SAME

(76) Inventors: Allen Paul Kisner, 824 Moreno Ave., Palo Alto, CA (US) 94303; Janet L. Kisner, 824 Moreno Ave., Palo Alto, CA (US) 94303

( * ) Notice: Subject to any disclaimer, the term of this patent is extended or adjusted under 35 U.S.C. 154(b) by 196 days.

(21) Appl. No.: 11/230,678

(22) Filed: Sep. 20, 2005

(65) Prior Publication Data

US 2007/0063857 A1 Mar. 22, 2007

Related U.S. Application Data

(60) Provisional application No. 60/714,521, filed on Feb. 1, 2005.

(51) Int. Cl.
*G08B 17/10* (2006.01)

(52) U.S. Cl. ..... 340/628; 340/693.5; 340/693.6

(58) Field of Classification Search ..... 340/628
See application file for complete search history.

(56) References Cited

U.S. PATENT DOCUMENTS

| | | | | | |
|---|---|---|---|---|---|
| 4,075,614 | A | * | 2/1978 | White | 340/594 |
| 4,623,878 | A | * | 11/1986 | Schoenwetter | 340/628 |
| 5,018,586 | A | * | 5/1991 | Cawley et al. | 169/56 |
| 5,396,221 | A | * | 3/1995 | Bridges | 340/628 |
| 5,625,345 | A | * | 4/1997 | Stark et al. | 340/628 |
| 6,075,447 | A | * | 6/2000 | Nightingale et al. | 340/628 |
| 6,087,946 | A | * | 7/2000 | Menard, Jr. | 340/618 |

* cited by examiner

*Primary Examiner*—Charles D. Garber
*Assistant Examiner*—Kerri L McNally
(74) *Attorney, Agent, or Firm*—Jerry R. Potts

(57) ABSTRACT

A tree smoke detection system and method which includes a conically shaped smoke collector housing having an interior wall extending between a wide entrance mouth opening and a narrow exit vent opening and a smoke detection device mounted to the interior wall to position the smoke detection device facing and adjacent to an imaginary center line passing through the wide entrance mouth opening and the narrow exit vent opening to facilitate detecting smoke flow along the imaginary center line.

18 Claims, 5 Drawing Sheets

TREE SMOKE DETECTION SYSTEM AND METHOD OF USING SAME

RELATED APPLICATIONS

This application claims priority to U.S. Provisional application No. 60/714,521, filed on Feb. 1, 2005, entitled "Tree Fire Smoke Detection System", which related application is incorporated herein by reference as though fully set forth.

BACKGROUND

There have been many different kinds of tree smoke detection systems. Nevertheless, there is a need for a new and improved tree smoke detection system which provides an early warning for an indoor tree fire which captures and concentrates smoke from the tree fire an a smoke detection device.

BRIEF SUMMARY OF THE INVENTION

The preferred embodiment of the present invention is directed to a tree smoke detection system and method which includes a conically shaped smoke collection housing having an interior wall extending between a wide entrance mouth opening and a narrow exit vent opening and a smoke detection device mounted to the interior wall to position the smoke detection device facing and adjacent to an imaginary center line passing through the wide entrance mouth opening and the narrow exit vent opening to facilitate detecting smoke flow along the imaginary center line.

DETAILED DESCRIPTION OF THE PREFERRED EMBODIMENTS

Figure 1:
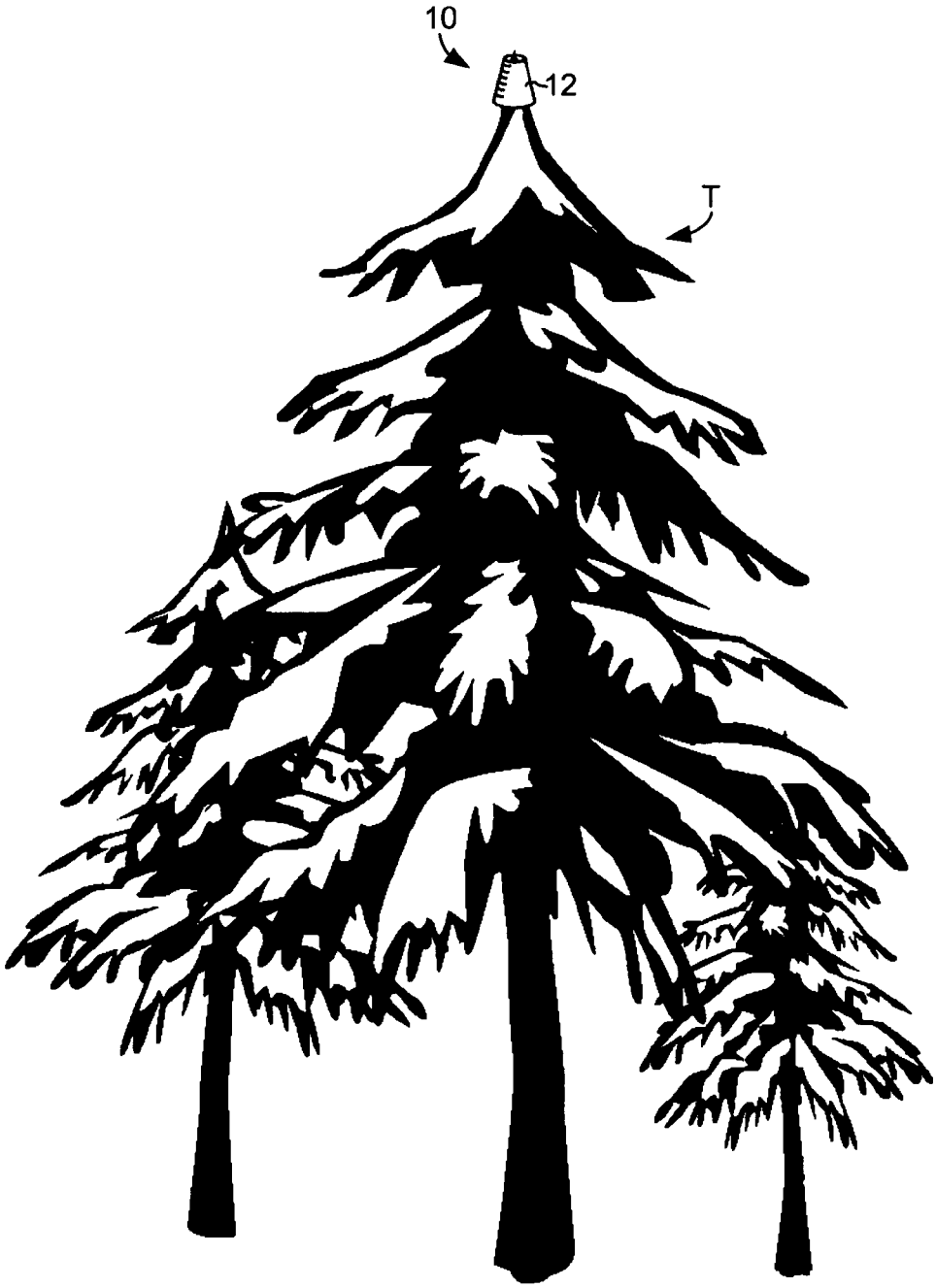
FIG. 1 is a diagrammatic illustration of a tree fire smoke detection system, which is constructed in accordance with a preferred embodiment of the present invention.
Figure 2:
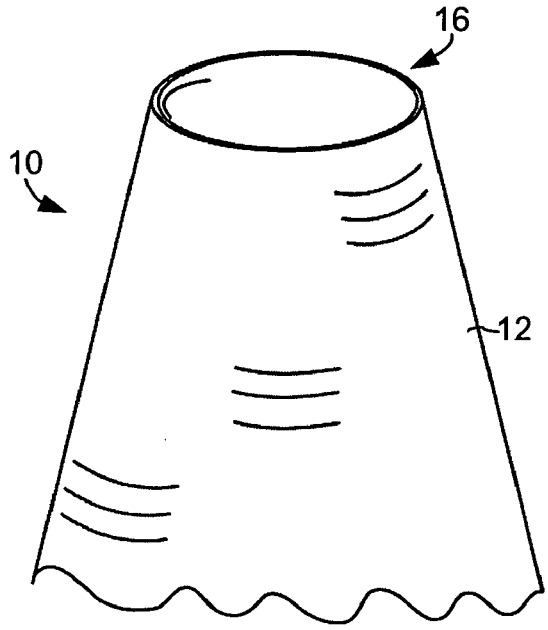
FIG. 2 is a greatly enlarged, cut-off pictorial view of a tip portion of a conically shaped smoke collector housing, which housing forms part of the tree fire smoke detection system of FIG. 1.

A system and method of tree fire smoke detection is disclosed. The following description is presented to enable any person skilled in the art to make and use the invention. For purposes of explanation, specific nomenclature is set forth to provide a thorough understanding of the present invention. Descriptions of specific applications and methods are provided only as examples. Various modifications to the preferred embodiments will be readily apparent to those skilled in the art, and the general principles defined herein may be applied to other embodiments and applications without departing from the spirit and scope of the invention. Thus, the present invention is not intended to be limited to the embodiments shown, but is to be accorded the widest scope consistent with the principles and steps disclosed herein.

Before discussing the new and novel system and method for tree fire smoke detection in greater detail, it may be beneficial to briefly review some of the prior art tree fire smoke detection systems. In some situations the conventional application of a smoke detection device has not always resulted in a sufficient early warning of an in process tree fire. That is, placing a smoke detection product near a tree may result in a delayed warning because of the fluid properties of smoke, which is a combination of excited gases. More specifically, the smoke generated by a tree fire behaves as a fluid with entrained particulates that tend to travel directly upward along the trunk of the tree producing a chimney effect. In this situation, a smoke detection device positioned outside the immediate trunk area of a tree can fail to detect the smoke for a considerable period of time while such a tree is burning. The new and improved system and method of tree fire smoke detection as disclosed herein, solves this problem as will be explained hereinafter in greater detail.

Referring now to the drawings and the detailed description that follows, there is illustrated in FIGS. 1-3 and 8, a tree fire smoke detection system 10, which is constructed in accordance with a preferred embodiment of the present invention. The tree fire smoke detection system 10 provides an early warning for indoor (as well as outdoor) tree fires by capturing and concentrating smoke at a smoke detection device 812 (FIG. 8), thereby increasing the reliability of early smoke detection from a single tree while, simultaneously, helping to reduce the time the smoke generated by such a fire, is detected for sounding an alarm.

Considering now the tree smoke detection system 10 in greater detail with reference to FIGS. 1-3 and 8, the tree smoke detection system 10 generally includes a semi conically shape smoke collector housing 12 which supports at about its exit a semi-conically shaped smoke detector housing 22 having mounted therein the smoke detector 812.

The smoke collector housing 12 has a wide entrance mouth or entrance opening indicated generally at 14 and a small narrow exit mouth or exit vent indicated generally at 16. As best seen in FIG. 1, the system 10 is adapted to be mounted at the tip of a tree, such as a tree T, where so positioned, it captures rising smoke and efficiently concentrates it at the mounting location of the smoke detector 812. More particularly, because the exit vent 16 is small and narrow, the smoke collector housing 12 is adapted to rest at the tip of the tree T. This is an important factor because the smoke collector housing 12 supports from its interior wall the conically shaped smoke detector housing 22 which is mounted at about the tip of the housing 12. The location of the smoke detector housing is an important feature of the present invention.

Figure 3:
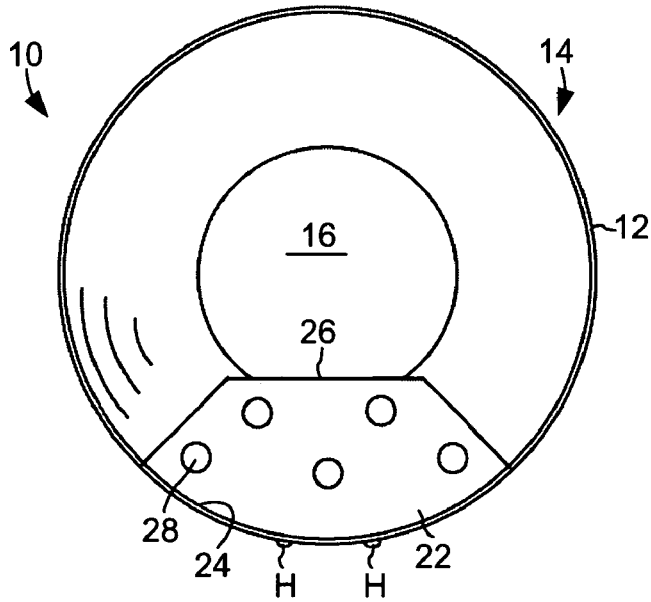
FIG. 3 is a bottom plan view of the cut-off tip portion of the conically shaped smoke collector housing of FIG. 2, illustrating the mounting location of a semi-conically shaped smoke detector housing which also forms part of the tree fire smoke detection system of FIG. 1.

The smoke detector housing 22, as best seen in FIG. 3, extends from the inner wall of the housing 12 toward the center of the cone so that its outwardly facing wall 26 is adjacent to and faces an imaginary longitudinal center line passing through the housing 12. The smoke detector housing 22 includes a series of randomly placed holes or apertures, such as an aperture 28 that allows smoke to enter into the interior of the housing 22.

The smoke detector housing 22 also includes an inwardly facing wall 24 which is secured to the interior wall of the housing 12 by a mounting hardware H. The smoke detector 812 is mounted inside the housing 22 to its outwardly facing wall 26. In this regard, the smoke detector 812 is mounted so that its smoke detection element, indicated generally at 822, is positioned adjacent the wall 26 at about the center of the cone column directly below the vent opening 16 as best seen FIG. 3. More particularly, the outwardly facing wall 26 is disposed adjacent an imaginary center line L, which passes through the center of the wide entrance mouth opening 14 and the center of the narrow exit vent opening 16. This mounting arrangement of positioning the smoke detector 822 at the wall 26 (which is positioned at about or adjacent to the imaginary center line L), in combination with the apertures 28, allows any smoke traveling up the trunk of the tree T, to flow into the smoke collector housing 12 and across the smoke detector element 822 at about the center of the cone column.

Figure 8:
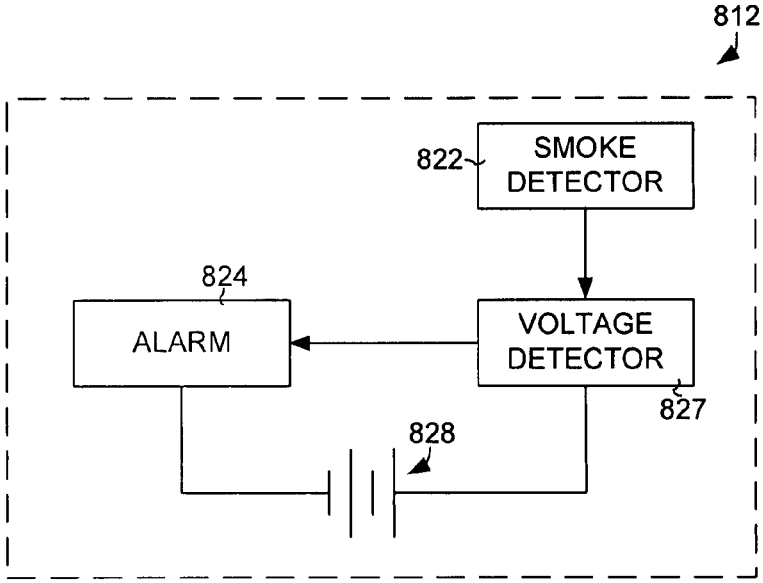
FIG. 8 is a schematic diagram of a smoke detector alarm circuit which forms part of the tree fire smoke detection system of FIG. 1.
Figure 9:
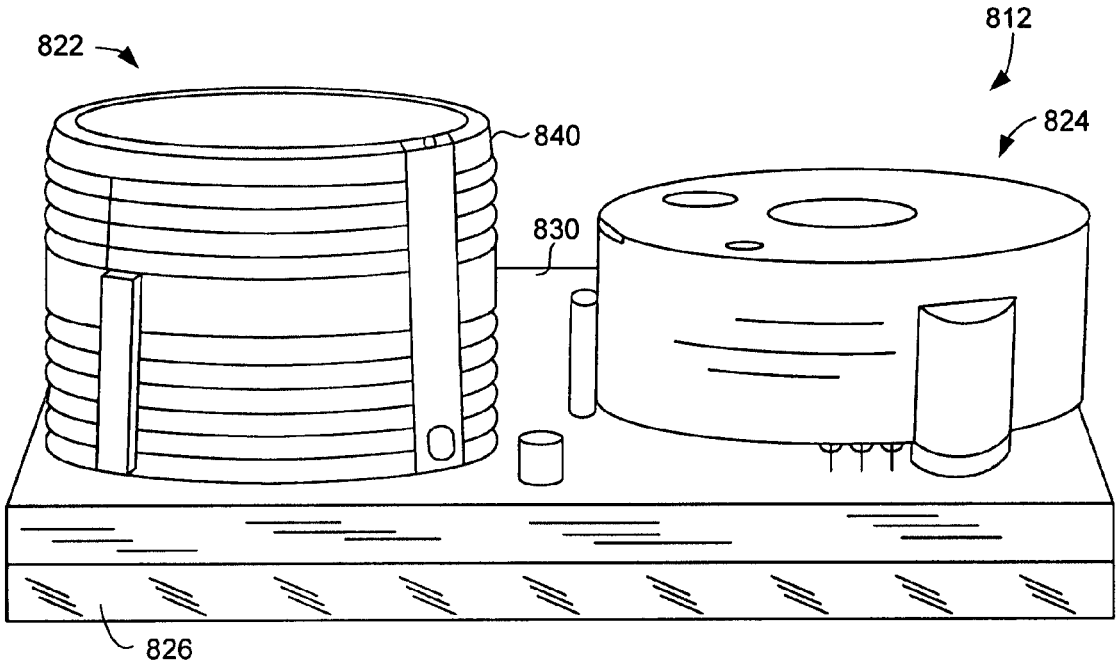
FIG. 9 is a pictorial view of the smoke detector alarm circuit of FIG. 8.

Considering now the smoke detector device 812 in greater detail with reference to FIGS. 8-9, the smoke detector device 812 is a conventional battery operated smoke detection device and includes an alarm arrangement 824, which provides sound that can be easily detected within a home for example. The alarm arrangement 824 is connected to a voltage detector 827 which is coupled to a smoke detector arrangement 822. The smoke detection device 812, as noted earlier, is a battery operated device and in this regards, it includes a battery 828 which is coupled between the alarm arrangement 824 and the voltage detector 827. As best seen in FIG. 9, the alarm arrangement 824 and the smoke detector arrangement 822, which includes a smoke detector housing 840, are mounted to a circuit board 830. In order to mount the circuit board 830, the bottom of the circuit board 830 is provided with either a sheet of hooks or a sheet of loops or piles indicated generally at 826. As the operation of such a smoke detector is well known to those skilled in the art, no further description will be provided in this disclosure.

Figure 4:
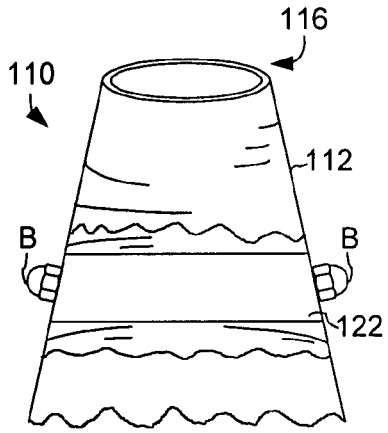
FIG. 4 is a cut-off pictorial view of a cut-away tip portion of another tree fire smoke detection system, which is constructed in accordance with another preferred embodiment of the present invention.
Figure 5:
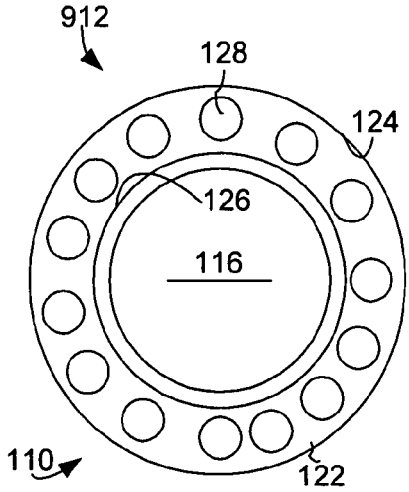
FIG. 5 is a bottom plan view of the cut-off tip portion of the conically shaped smoke collector housing of FIG. 4, illustrating the mounting location of a conically shaped smoke detector housing which also forms part of the tree fire smoke detection system of FIG. 4.

Referring now to the drawings and more particularly to FIGS. 4-5, there is illustrated another tree fire smoke detection system 110 which is constructed in accordance with another preferred embodiment of the present invention. The tree fire smoke detection system 110 is similar to the system 10 and includes a smoke detection device 912, a smoke collection housing 112 and a smoke detector housing 122. As the smoke collection housing 112 is substantially similar to housing 12 it will not be described hereinafter in greater detail.

Considering now the smoke detection housing 122 in greater detail with reference to FIGS. 4-5, the smoke detection housing 122 is conically shaped and dimensioned to engage the inner wall of the smoke collection housing 112 in a snug tight fit. The smoke detection housing 122 is secured in place at about the tip of the smoke collection housing 112 by a pair of bolts B which extend through an outer wall of the smoke collection housing 112 and into an outer wall 124 of the smoke detection housing 122. As will be explained hereinafter in greater detail, the smoke detector device 912 is mounted to an inwardly facing wall 126 of the smoke detector housing 122.

In order to help concentrate the smoke traveling up the trunk of the tree T for detection by the smoke detection device 912, the smoke detection housing 122 includes a series of spaced apart apertures or holes, such as hole 128, that extend around the circumference of the housing 122. The holes 128 allow smoke to enter the interior of the housing 122 and flow into the smoke detection device 912 for easy detection.

Considering now the smoke detection device 912 in greater detail with reference to FIG. 5, the smoke detection device 912 generally includes a plurality of smoke detection devices, such as the smoke detection device 812. The individual smoke detection devices 812 are mounted in a generally straight line arrangement extending from the inwardly facing wall 124 to the outwardly facing wall 126 of the smoke detection housing 122.

Figure 6:
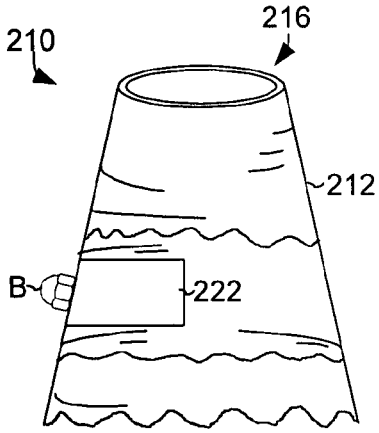
FIG. 6 is a cut-off pictorial view of a cut-away tip portion of another tree fire smoke detection system, which is constructed in accordance with another preferred embodiment of the present invention.
Figure 7:
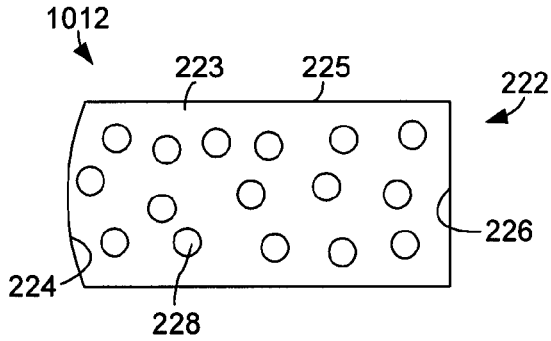
FIG. 7 is a bottom plan view of the cut-off tip portion of the conically shaped smoke collector housing of FIG. 6, illustrating the mounting location of a conically shaped smoke detector housing which also forms part of the tree fire smoke detection system of FIG. 6.

Referring now to the drawings and more particularly to FIGS. 6-7, there is illustrated another tree fire smoke detection system 210 which is constructed in accordance with another preferred embodiment of the present invention. The tree fire smoke detection system 210 is similar to the system 10 and includes a smoke detection device 1012, a smoke collector housing 212 and a smoke detector housing 222. As the smoke collection housing 212 is substantially similar to housing 12, it will not be described hereinafter in greater detail. It should be noted however, that the smoke collector housing 212, like smoke collector housing 12, also includes a small narrow exit vent 216 and a wide entrance opening which allows the housing 212 to rest at the top of a tree T.

Considering now the smoke detection housing 222 in greater detail with reference to FIGS. 6-7, the smoke detection housing 222 has an irregular shape which is cube like except for its front wall 224. In this regard, the front wall 224 slopes outwardly, from a top wall portion 223 of the housing 222, to meet a bottom wall portion 225 of the housing 222. The slope of the front wall 224 and the shape of the front wall 224 are provided to correspond and engage the inner wall of the smoke collection housing 212 in a snug tight fit. The smoke detection housing 222 is long and narrow so that when its is mounted to the interior wall of housing 212, its back wall indicated generally at 226 is positioned at about the center of the cone column formed by the smoke collection housing 212. In this regard, its outer wall 216 is disposed adjacent to the trunk of the tree.

The smoke detector housing 222 is secured in place at about the tip of the smoke collection housing 212 by a single bolt B which extends through an outer wall of the smoke collection housing 212 and into the outer wall 224 of the smoke detection housing 222. As will be explained hereinafter in greater detail, the smoke detector device 1012 is mounted to the inwardly facing wall 226 of the smoke detector housing 222.

In order to help concentrate the smoke traveling up the trunk of the tree T for detection by the smoke detection device 1012, the smoke detection housing 222 includes a series of spaced apart apertures or holes, such as hole 228, that extend from the inner wall 223 to the outer wall 226. The holes 228 allow smoke to flow into the interior of the housing 222 for easy detection by the smoke detection device 1012.

Figure 10:
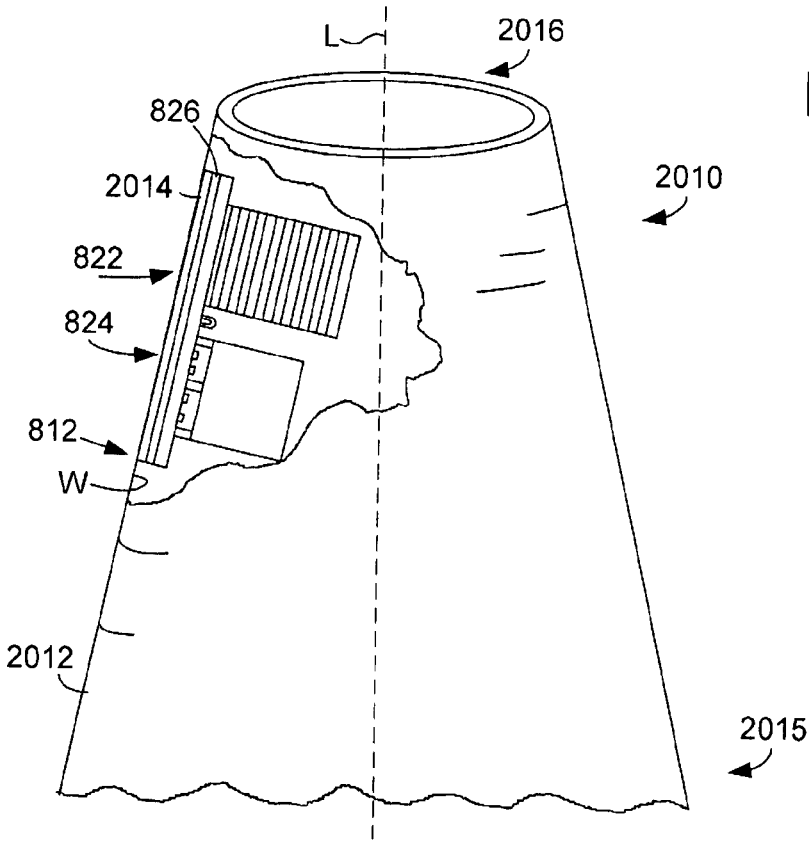
FIG. 10 is a cut-off pictorial view of a cut-away tip portion of another tree fire smoke detection system, which is constructed in accordance with another preferred embodiment of the present invention.
Figure 11:
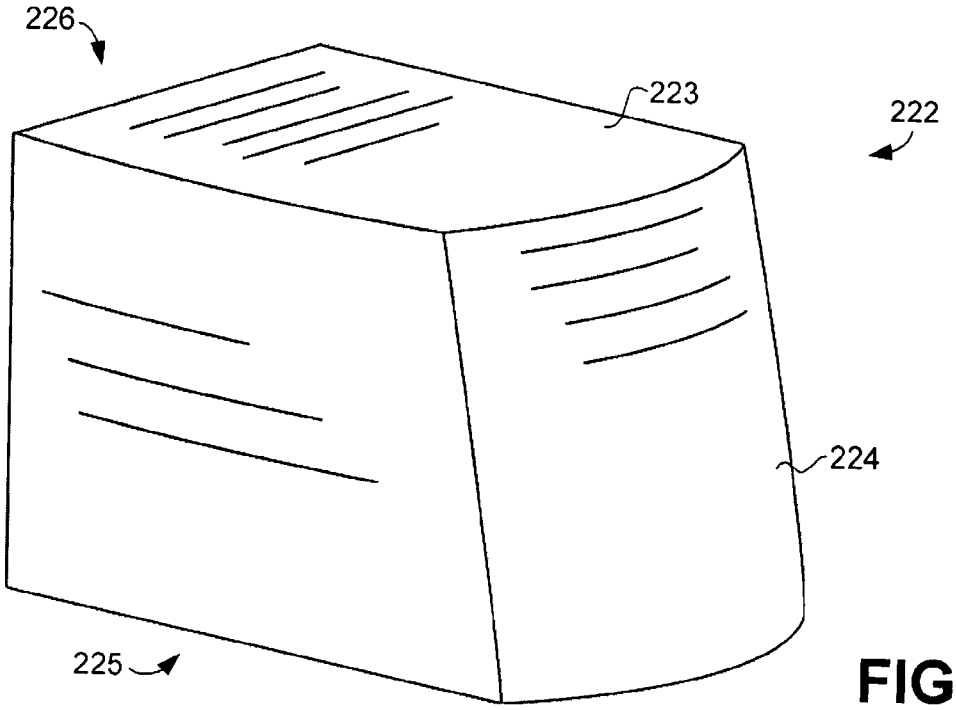
FIG. 11 is a pictorial view of the smoke detector housing illustrated in FIG. 6.

Referring now to the drawings and more particularly to FIG. 10, there is illustrated another tree fire smoke detection system 2010 which is constructed in accordance with another preferred embodiment of the present invention. The tree fire smoke detection system 2010 generally includes a smoke detector arrangement 812 and a conically shaped tree smoke collector 2012.

The tree smoke collector 2012, as best seen in FIG. 10, has a large mouth bottom opening 2015 and a very narrow or small mouth top opening indicated generally 2016. As will be explained hereinafter in greater detail, the mouth openings 2015 and 2016 are aligned along a common longitudinal axis of the tree smoke collector defined by an imaginary line L.

The tree smoke collector 2012 includes a strip of either hooks or piles 2014 adhesively secured to its interior wall, indicated generally at W, to help secure or mount the smoke detector arrangement 812 to its interior wall W via the sheet of hooks or piles 826 disposed on smoke detector arrangement 812. It should be noted that the placement of the strip of either hooks or piles 2014 cooperates with the sheet of hooks or piles disposed on the circuit board 830, to help position the smoke detector housing 840 at about the opening 2016 and immediately adjacent to the longitudinal axis of the tree smoke collector 2012 as defined by the imaginary center line L. This mounting arrangement assures that the smoke particles traveling up the trunk of the tree T in the event of a tree fire will be captured by the collector 2012 and pass directly into the housing 840 of the smoke detector 822 to cause an alarm condition to be sounded via the alarm 824.

While a particular embodiment of the present invention has been disclosed, it is to be understood that various different modifications are possible and are contemplated within the true spirit and scope of the appended claims. There is no intention, therefore, of limitations to the exact abstract or disclosure herein presented.

We claim:

1. A smoke detection system, comprising:

a smoke collector housing for funneling smoke traveling along a tree trunk into a smoke detector disposed at about a tip portion of said smoke collector housing;

said smoke collector housing having a wide entrance mouth for receiving a tip portion of the tree trunk therein and for helping to funnel the smoke traveling along the tree trunk toward said tip portion of the tree trunk; and said smoke collector housing further having a narrow exit mouth for helping to establish a upward draft along said tip portion of the tree trunk so the smoke will travel into said smoke detector and vent from said smoke collector housing in a flow stream.

2. The smoke detection system according to claim 1, wherein said smoke collector housing has a conical shape.

3. The smoke detection system according to claim 2, wherein said smoke detector is mounted within the interior of said smoke collector housing at about said narrow exit mouth.

4. The smoke detection system according to claim 3, wherein said smoke detector is mounted facing and adjacent to an imaginary center line passing through said narrow exit mouth and said wide entrance mouth.

5. The smoke detection system according to claim 4, wherein said narrow exit and said wide entrance mouth are disposed in parallel planes relative to one another.

6. The smoke detection system according to claim 5, wherein said smoke detector is mounted to a circuit board having an electrically powered alarm for providing an auditory sound when said smoke detector senses the presence of smoke.

7. The smoke detection system according to claim 6, wherein said circuit board is mounted to said smoke collector housing by mounting means.

8. The smoke detection system according to claim 7, wherein said mounting means is partially disposed on said circuit board and partially disposed on an interior wall of said smoke collector housing.

9. The smoke detection system according to claim 8 wherein said mounting means partially disposed on said circuit board is either hooks or piles and wherein said mounting means disposed on said interior wall of said smoke collector housing is either piles or hooks.

10. A smoke detection system, comprising:

a conically shaped smoke collection housing having an interior wall extending between a wide entrance mouth opening and a narrow exit vent opening; a semi-conically shaped smoke detector mounted within said conically shaped smoke collector housing and having an inwardly facing wall and an outwardly facing wall; and a smoke detection device mounted to said outwardly facing wall and positioned adjacent an imaginary center line passing through the center of said wide entrance mouth opening and the center of said narrow exit vent opening to facilitate detecting smoke flow along said imaginary center line.

11. The smoke detection system according to claim 10, wherein said semi-conically shaped smoke detector includes a bottom wall having a plurality of randomly space smoke entry holes.

12. The smoke detection system according to claim 10, wherein said semi-conically shaped smoke detector includes a bottom wall having a plurality of randomly spaced smoke entry holes extending from said inwardly facing wall to said outwardly facing wall.

13. The smoke detection system according to claim 11, wherein said semi-conically shaped smoke detector includes a top wall for helping to capture and direct smoke flow within an interior portion of said semi-conically shaped smoke detector.

14. A method of using a smoke detection system, comprising:

mounting a nested pair of conically shaped housing at the tip of a tree trunk;

wherein an external one of said housing is a smoke collector housing and wherein an internal one of said housing is a smoke detection housing;

mounting a smoke detection device having a plurality of smoke detectors within said smoke detection housing; and activating said smoke detection device so that any smoke traveling up said tree trunk and collected by said smoke collector housing will be detected by said smoke detection.

15. A tree fire smoke detection system, comprising:

a conically shaped tree smoke collector having a single wall construction, said tree smoke collector having a narrow mouth top opening and a wide mouth bottom opening;

a strip of hooks or piles secured to an interior wall of said tree smoke collector at about said narrow mouth opening; and a smoke detector circuit mounted on a circuit board, wherein said circuit board has one of its surfaces covered with hooks or piles to facilitate mounting said circuit board to said strip of hooks or piles secured to an interior wall of said tree smoke collector at about said narrow mouth opening.

16. A smoke detection system, comprising:

a nested pair of conically shaped housings, wherein an external one of said housings is a smoke collector housing and wherein an internal one of said housings is a smoke detection housing; and a smoke detection device having a plurality of smoke detectors mounted within said smoke detection housing.

17. The smoke detection system according to claim 16, wherein said smoke detection housing has a generally circularly bottom wall with a plurality of substantially equally spaced house extending around the circumference of said bottom wall.

18. A method of using a smoke detection system, comprising:

mounting a smoke collector housing at about the tip of a tree trunk, said smoke collector housing having a smoke detector mounted therein;

said smoke collector housing having a wide entrance mouth for receiving the tip portion of the tree trunk therein and for helping to funnel smoke traveling along the tree trunk toward said tip portion of said tip portion of the tree truck;

said smoke collector housing further having a narrow exit mouth for helping to establish a upward draft along said tip portion of the tree trunk so the smoke will travel into said smoke detector and vent from said smoke collector housing in a flow stream; and sounding an audible alarm when smoke drafts along said tip portion of the tree trunk and into said smoke detector.

* * * * *